United States Patent [19]

Castle

[11] 4,052,057

[45] Oct. 4, 1977

[54] ELECTRONIC AMUSEMENT MACHINE

[76] Inventor: Trevor William Castle, 10 Thornton St., Eltham, 3095, Australia

[21] Appl. No.: 606,078

[22] Filed: Aug. 20, 1975

[30] Foreign Application Priority Data

Aug. 20, 1974 Australia ..... 8591/74

[51] Int. Cl.[2] ..... A63F 1/00

[52] U.S. Cl. ..... 273/1 E; 273/138 A

[58] Field of Search ..... 235/92 GA; 273/1 E, 273/85 R, 54 C, 86 B, 130 AB, 136 A, 138 A, 142 B, 143 R, 143 A–143 C; 340/323 R, 339; 35/9 A

[56] References Cited

U.S. PATENT DOCUMENTS

| | | | |
|---|---|---|---|
| 3,384,888 | 5/1968 | Harnden, Jr. et al. | 340/339 |
| 3,735,982 | 5/1973 | Gerfin | 273/138 A |
| 3,770,269 | 11/1973 | Elder | 273/138 A |
| 3,796,433 | 3/1974 | Fraley | 273/138 A |
| 3,865,368 | 2/1975 | Grazebrook | 273/138 A |
| 3,876,208 | 4/1975 | Wachtler et al. | 273/1 E X |
| 3,939,579 | 2/1976 | Andrews et al. | 35/9 A |

OTHER PUBLICATIONS

*Radio Electronics;* "Electronic Casino, Part I"; Mar. 1974; pp. 45, 50, 51, 52, 86.

*Radio Electronics;* "Electronic Casino, Part II"; Apr. 1974; pp. 58, 59.

*Primary Examiner*—Anton O. Oechsle

*Assistant Examiner*—Vance Y. Hum

*Attorney, Agent, or Firm*—Cushman, Darby, Cushman

[57] ABSTRACT

The invention relates to an electronic amusement machine and there is disclosed such a machine for playing a form of the card game commonly known as poker. The machine disclosed is suitable for two players and includes a playing face and a storage face. On initiation of a game, five cards are successively randomly illuminated on said playing face and then transferred to the storage face automatically. A second five cards are then successively randomly illuminated on said playing face and on completion may be compared with the cards illuminated on said storage face. The possibility of more than one storage face is also mentioned and the disclosure includes detailed circuit diagrams for the complete machine including detailed circuitry for the store function. The machine disclosed also includes a reject facility whereby each player has the option of rejecting, within a short time, up to five cards as they randomly appear on the playing face.

8 Claims, 16 Drawing Figures

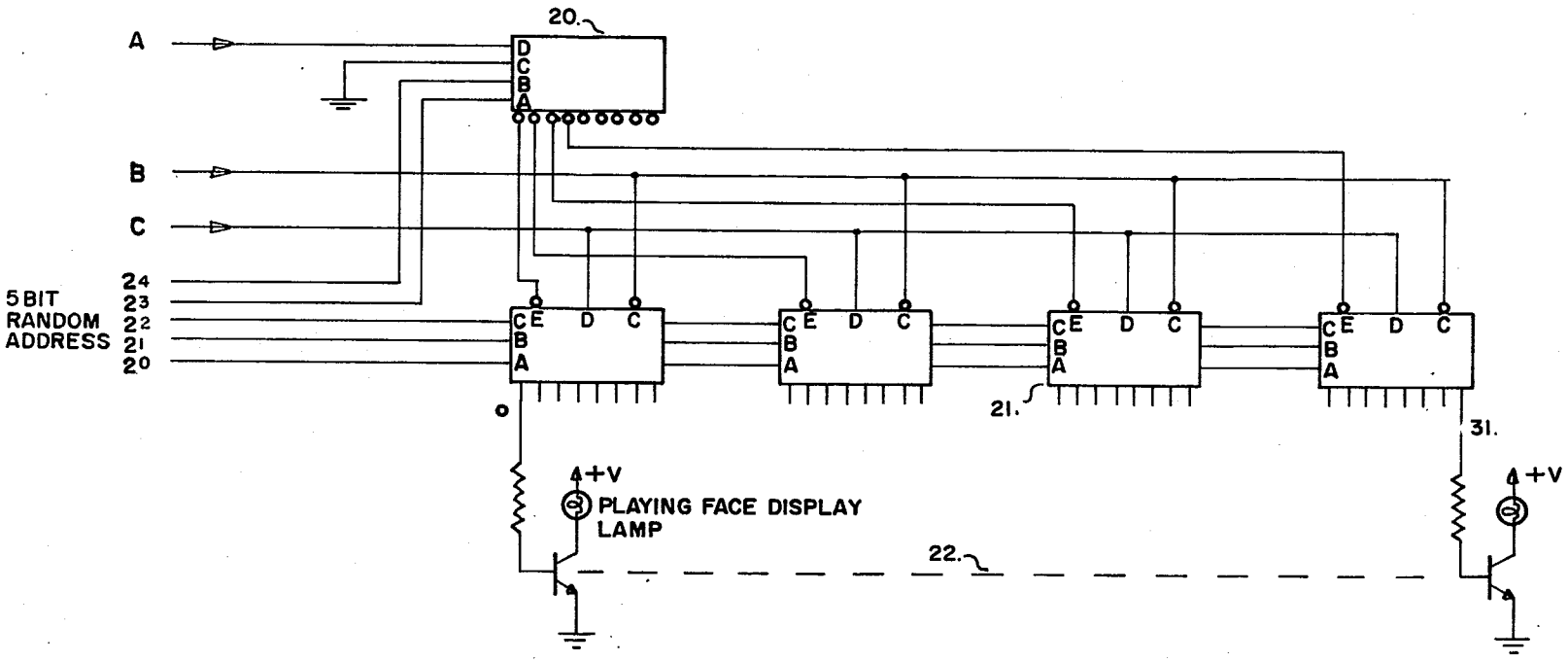
FIG. 2 PLAYING FACE DISPLAY MEMORY

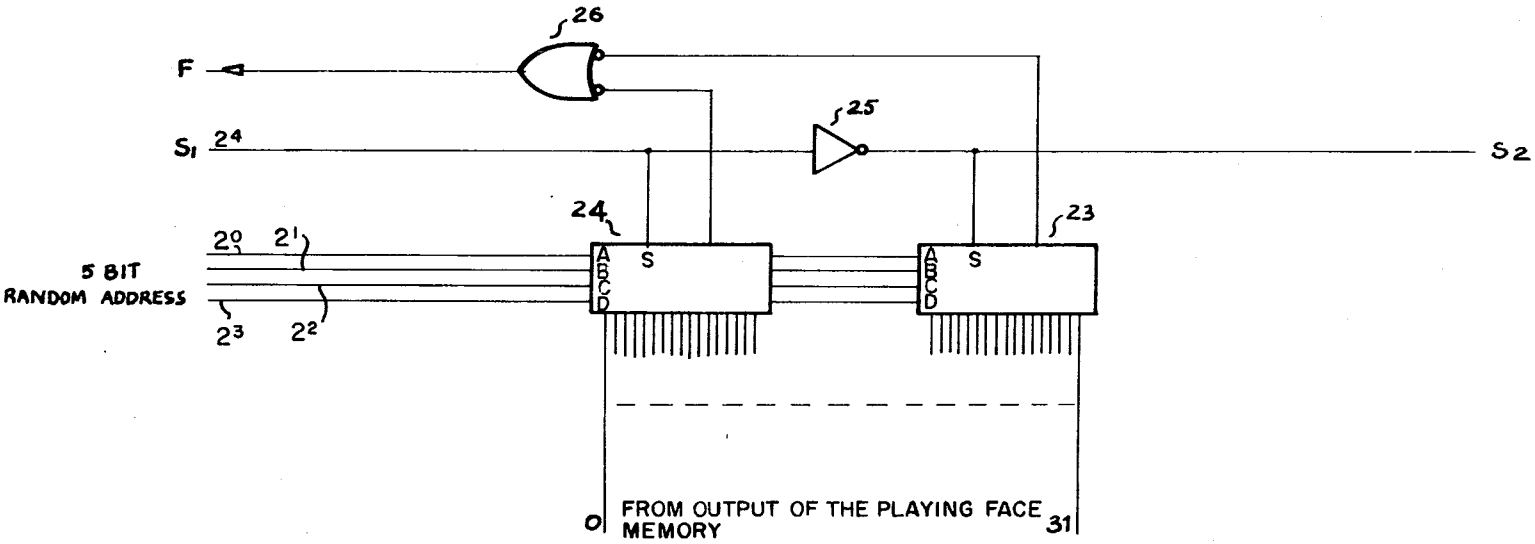
FIG. 3 DISPLAY MEMORY FREE/BUSY DETECT

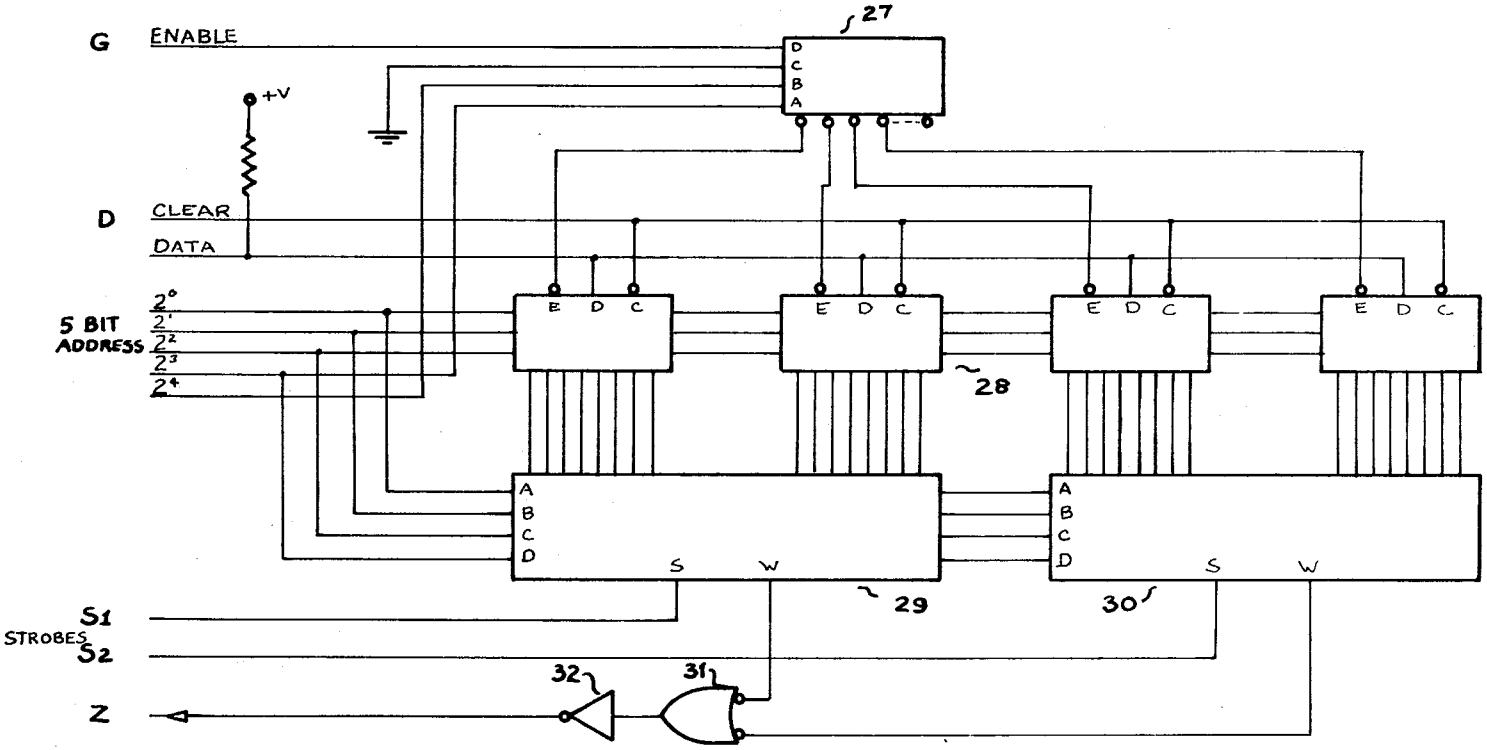
FIG 4 DIGITAL SELECTION MEMORY

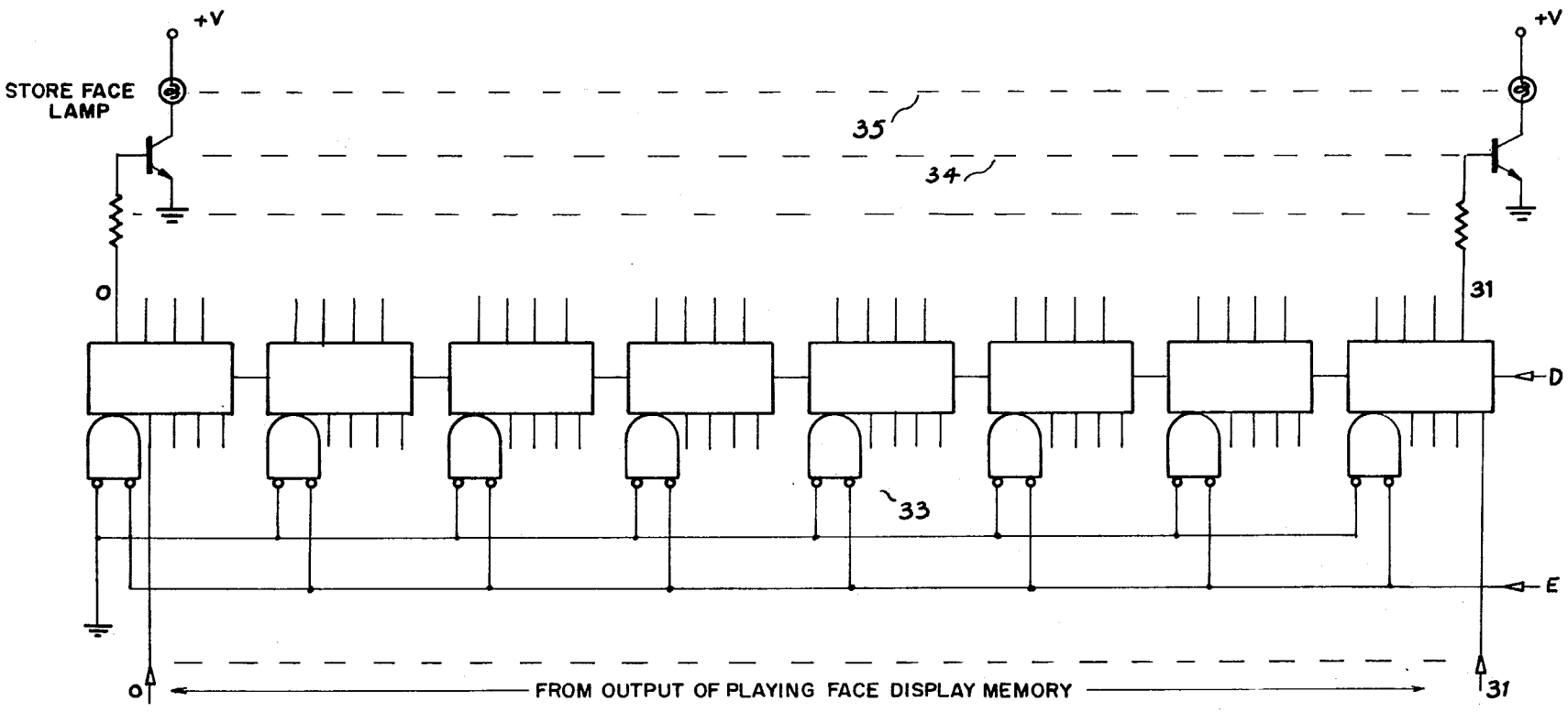
FIG 5 STORE FACE DISPLAY MEMORY

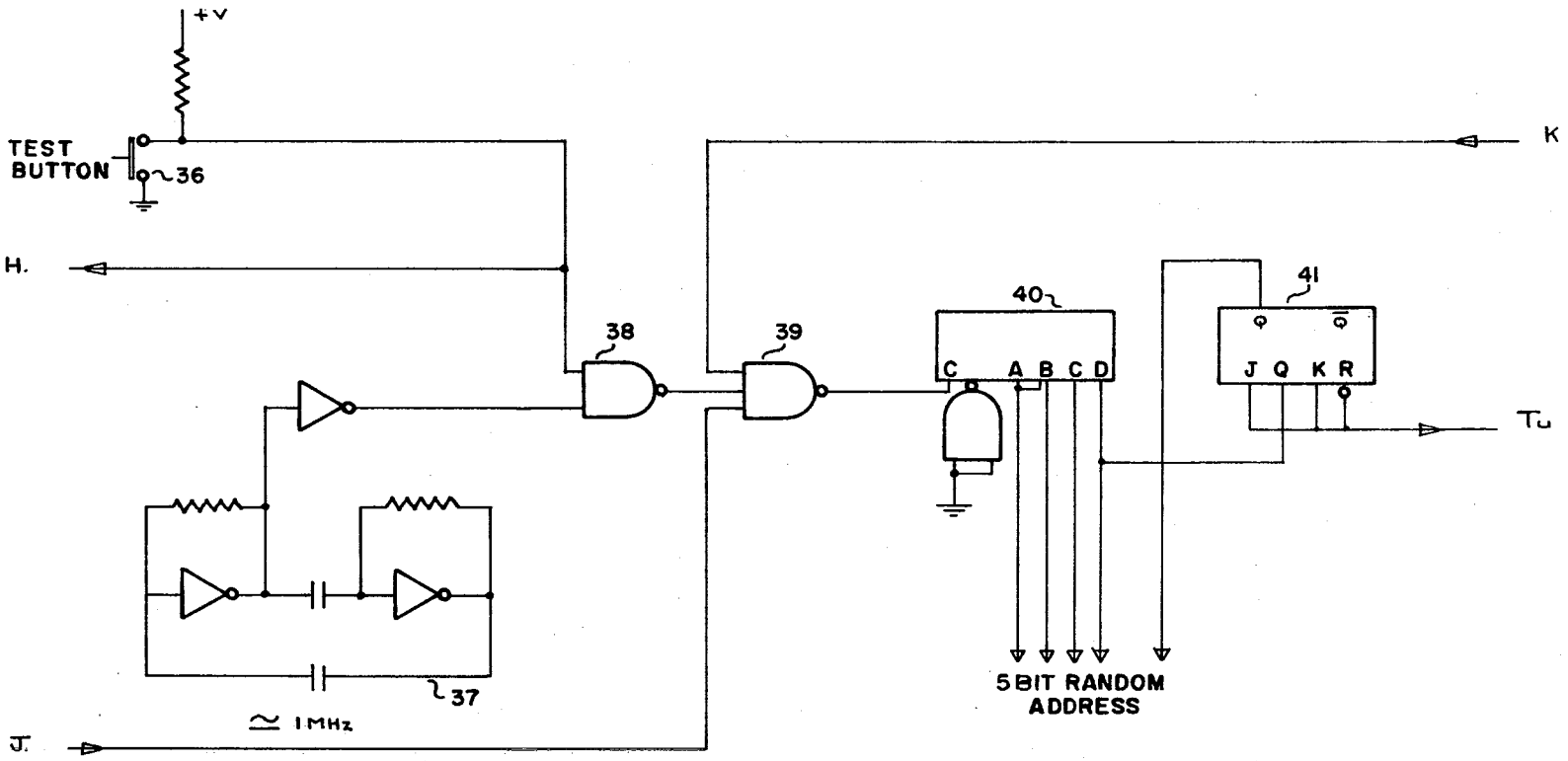
FIG. 6 RANDOM ADDRESS GENERATOR

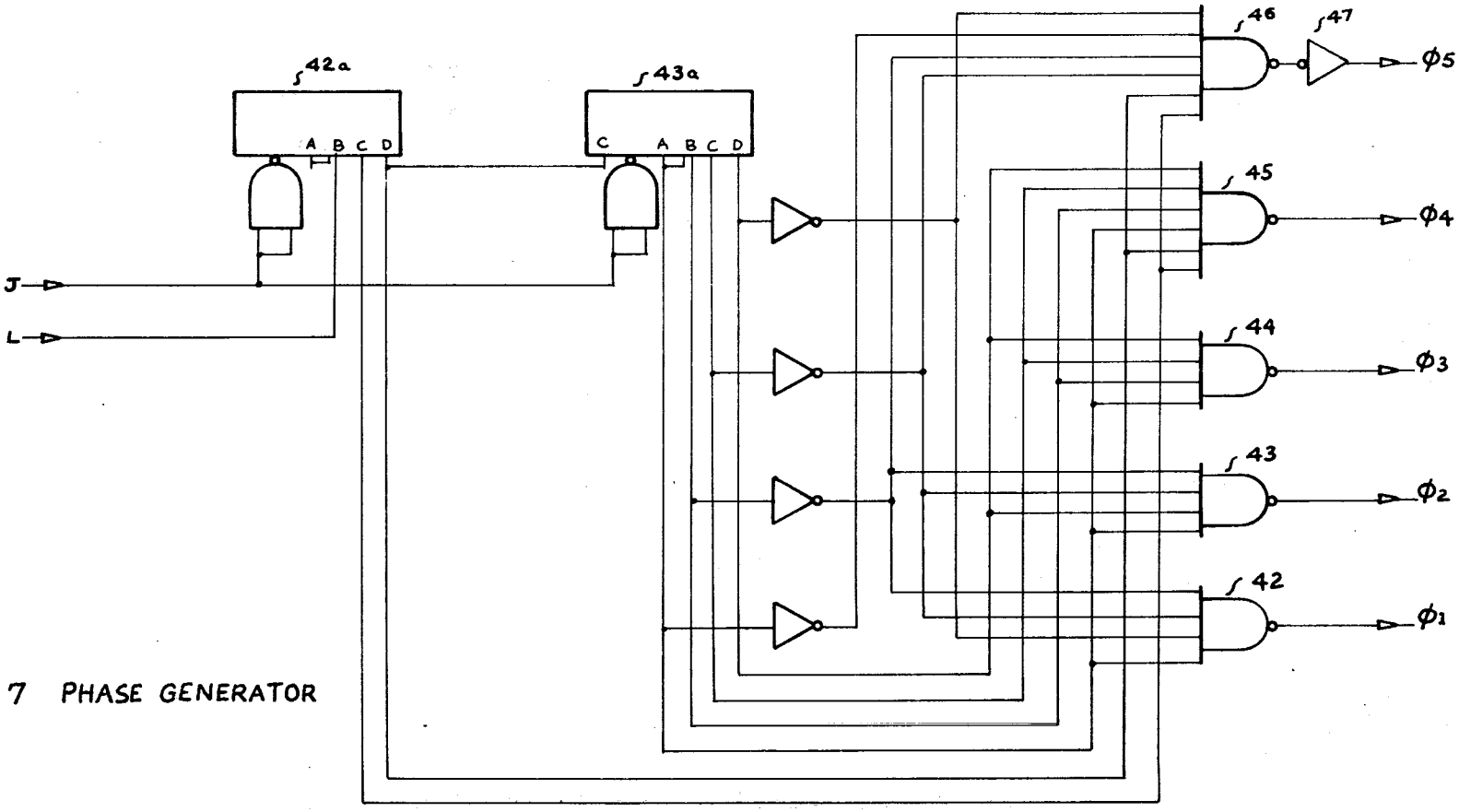
FIG. 7 PHASE GENERATOR

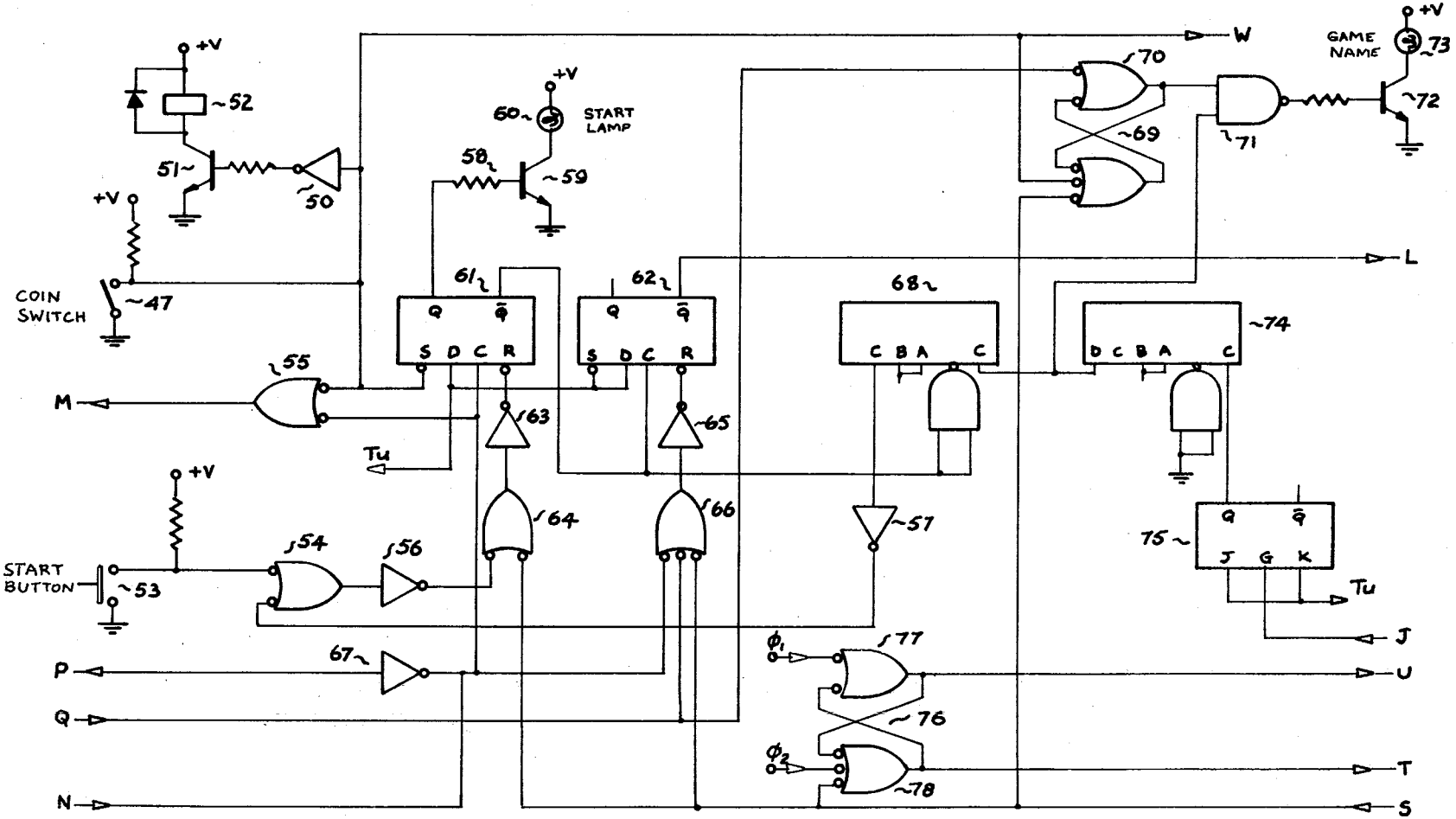
FIG. 8 GAME CONTROL CIRCUIT

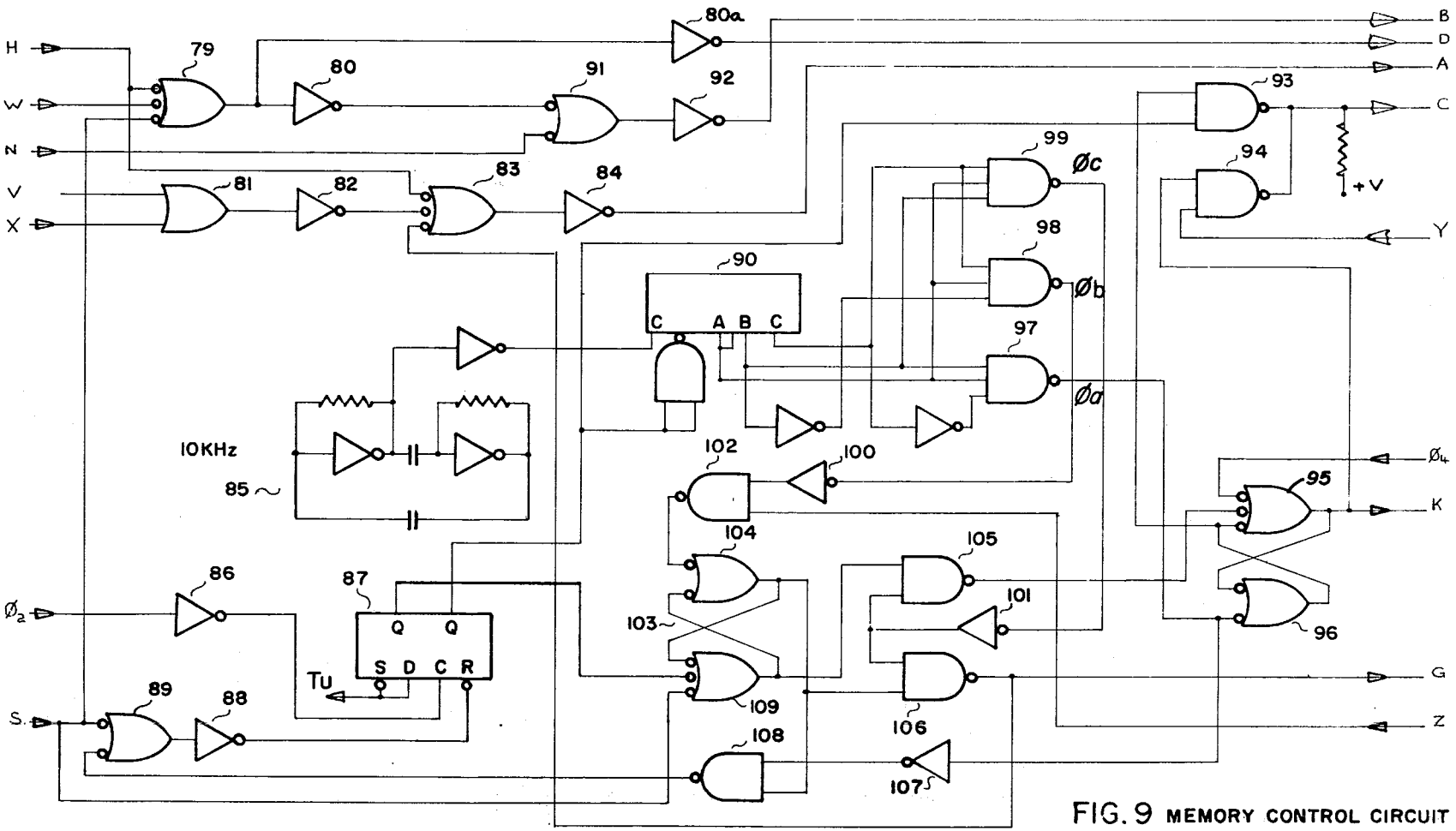
FIG. 9 MEMORY CONTROL CIRCUIT

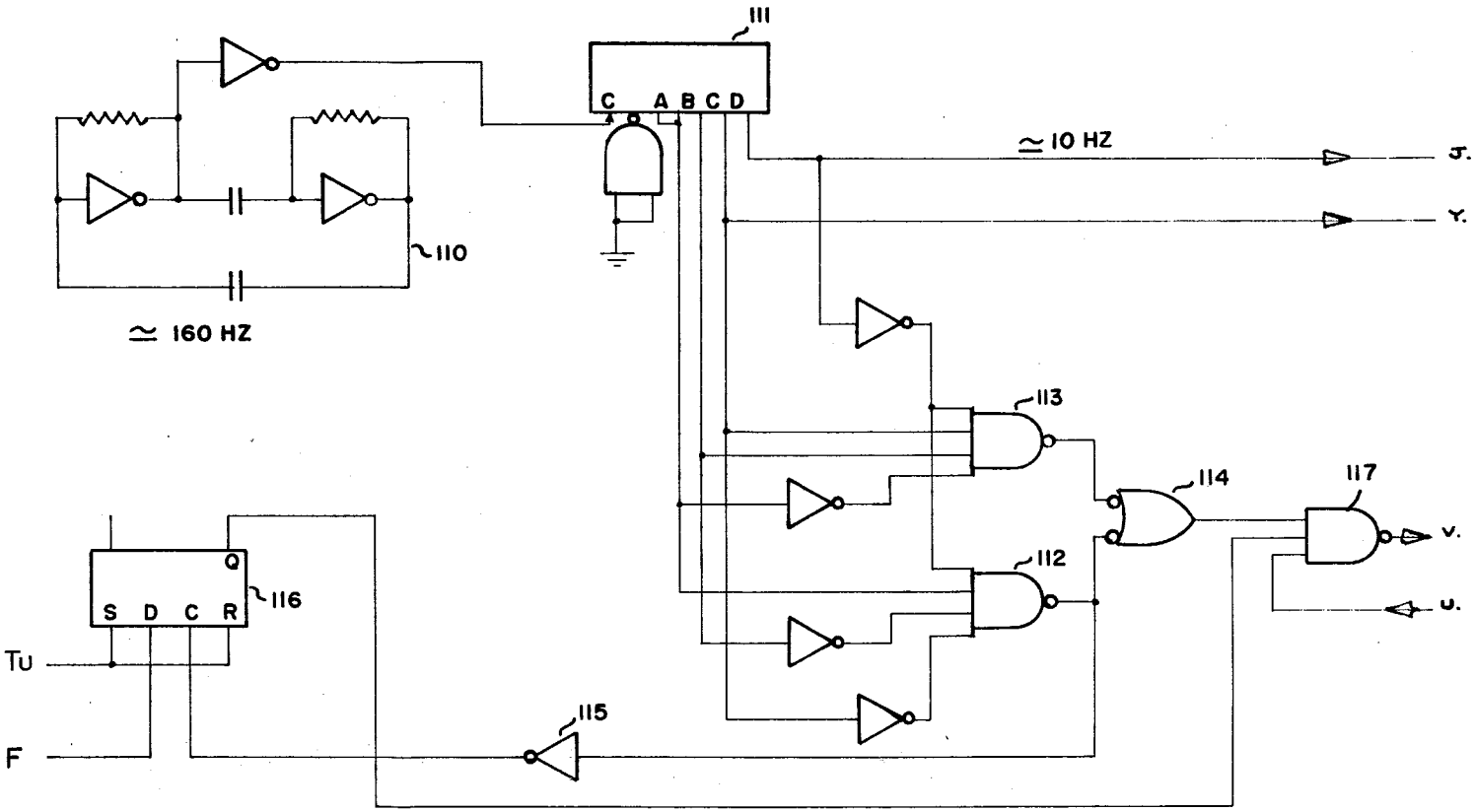
FIG. 10 SHUFFLE SIMULATION CIRCUIT

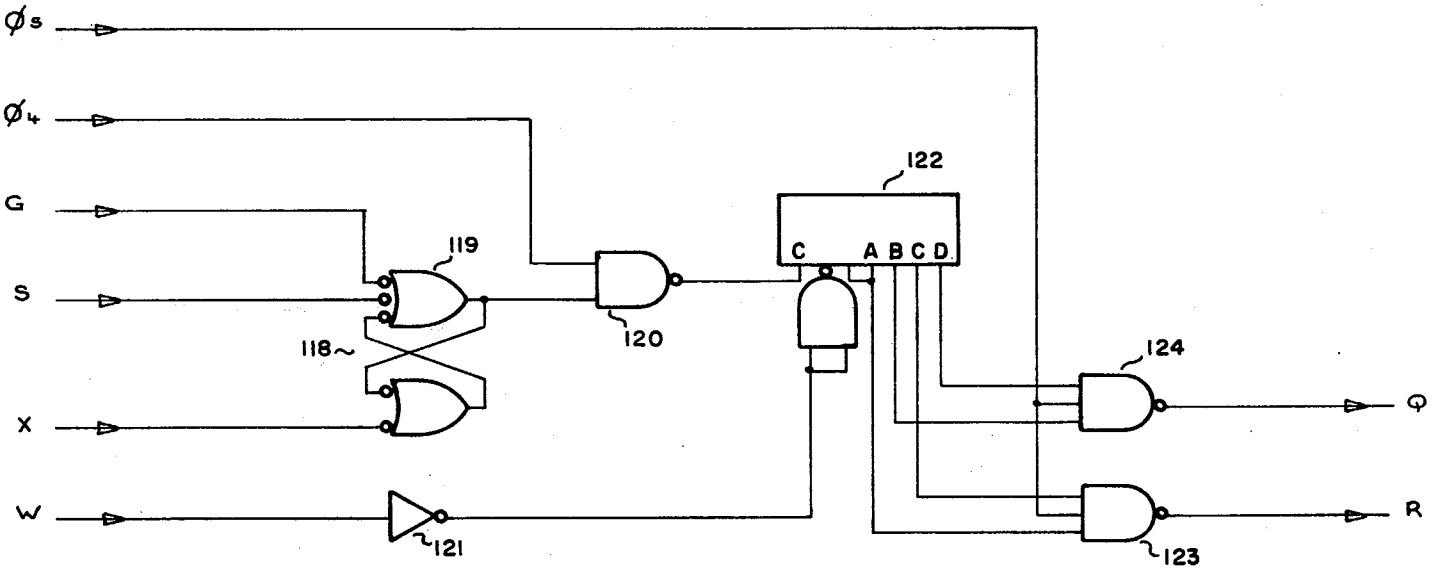
FIG. 11 DISPLAY NUMBER COUNTER

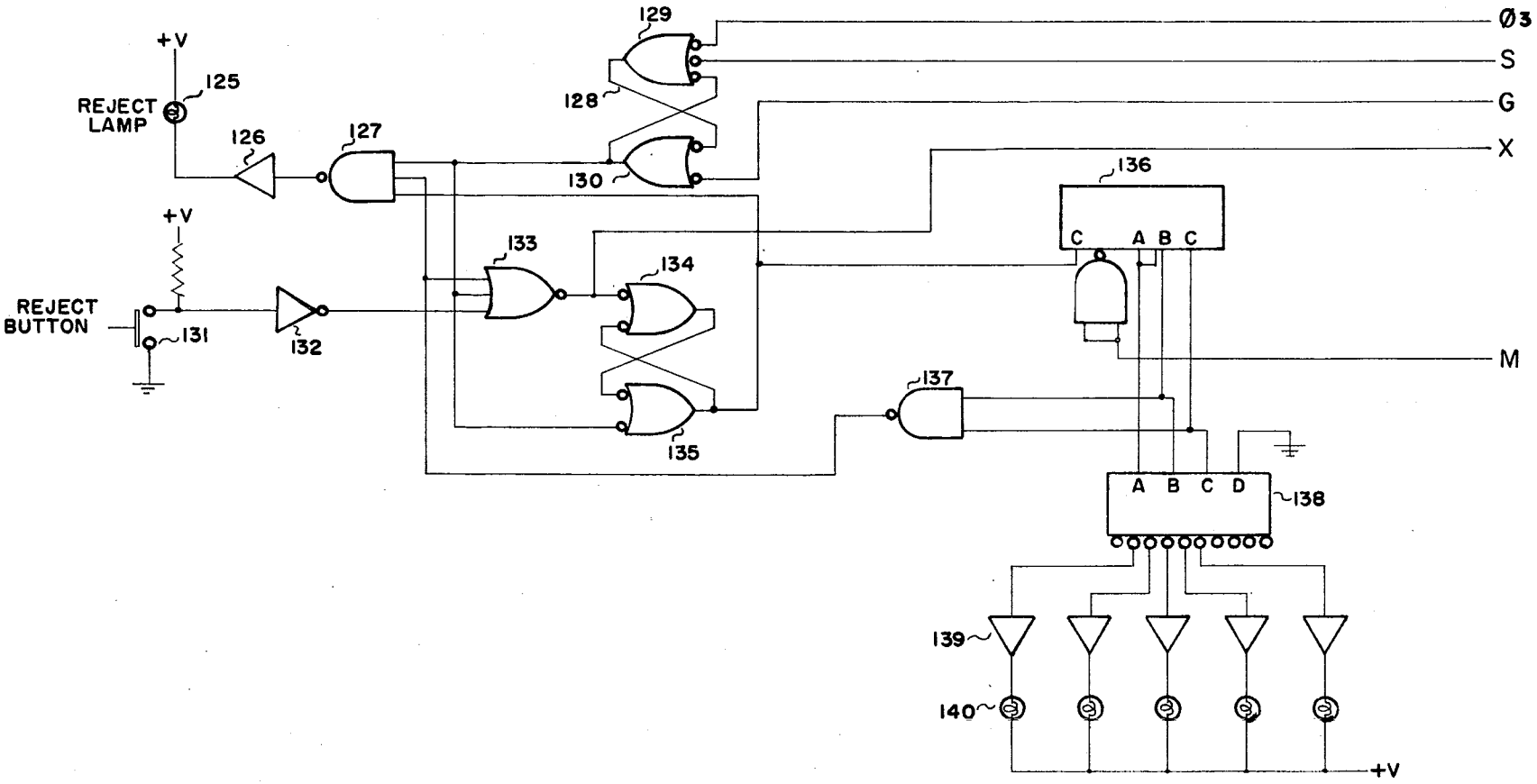
FIG. 12 DISPLAY REJECT CIRCUIT

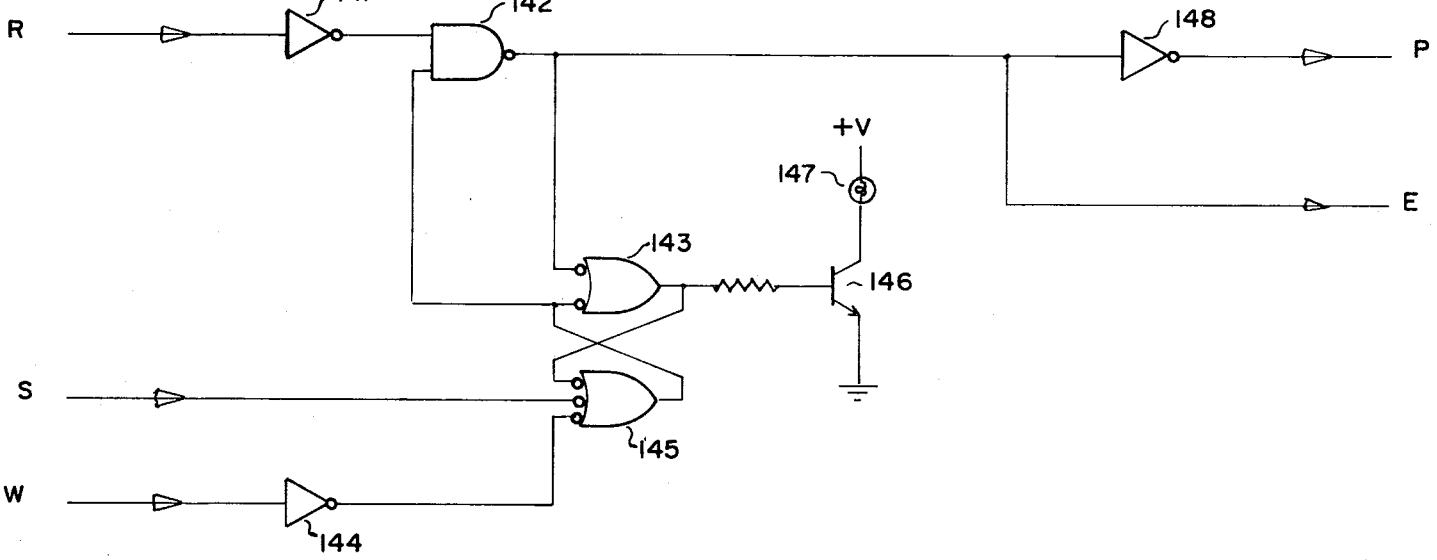
FIG. 13 LOAD STORE MEMORY CIRCUIT

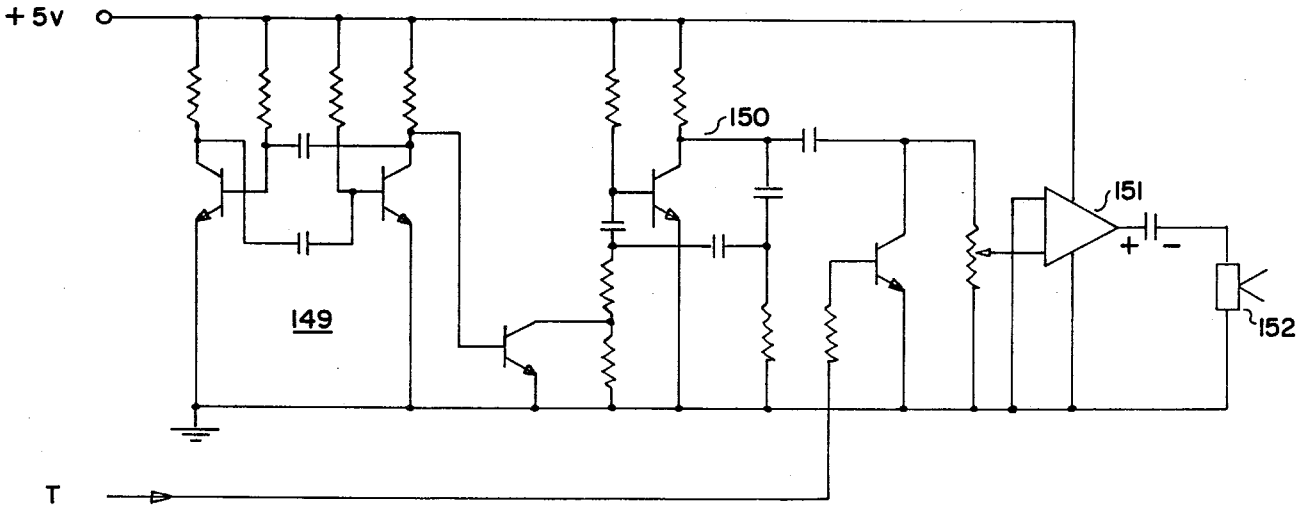
FIG. 14 AUDIO CIRCUIT

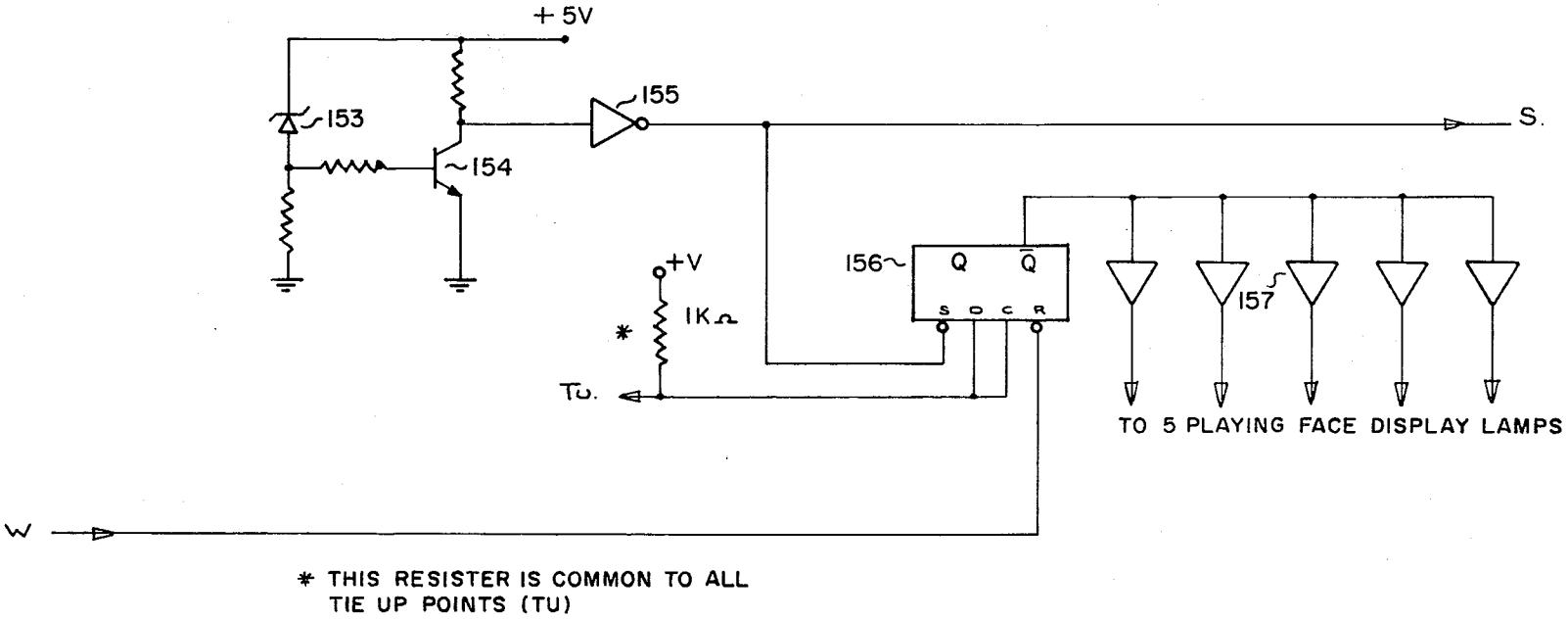
FIG. 15 MASTER RESET CIRCUIT

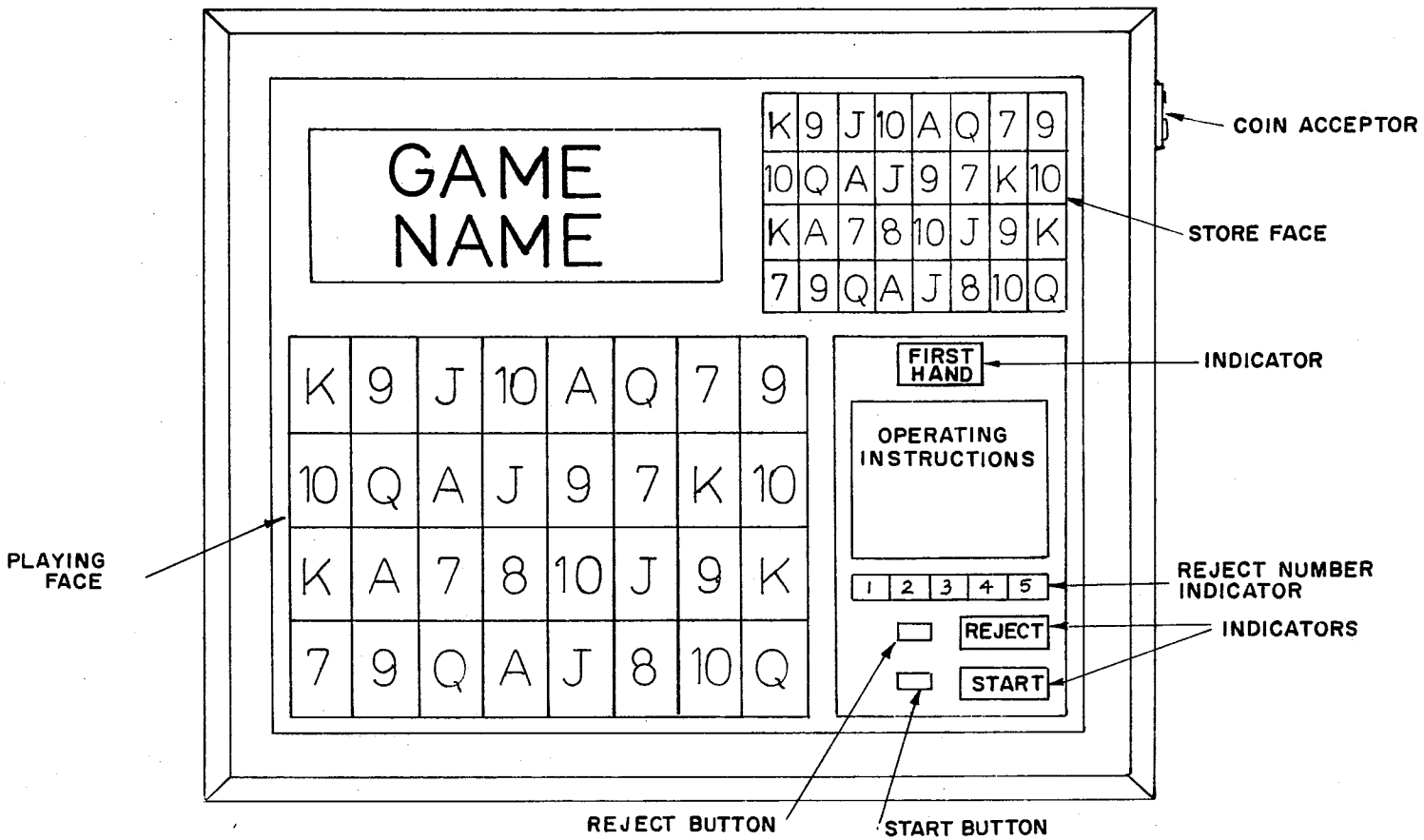
FIG.16 FACE VIEW OF MACHINE

ELECTRONIC AMUSEMENT MACHINE

This invention relates to amusement machines and more particularly to an electronic amusement machine of the kind having a visual display face and being suitable for playing card games, for example, poker. Of course the invention is not limited to card games and it will be apparent from the description hereinbelow that the visual display face could be altered to enable playing of any game wherein a predetermined number of characters or displays are randomly illuminated in a timed sequence and assessed against a set of predetermined rules.

Machines of the above general type are known and descriptions thereof may be found, for example, in Australian Pat. No. 436,874 and corresponding U.S. Pat. No. 3,889,956 in the name of T. Castle, as well as in the U.S. Pat. No. 3,735,982 in the name of Jay N. Gerfin. The machine described in the Australian Pat. No. 436,847 successively illuminates different cards randomly from a display face of 20 cards until five cards, representing a poker hand, have been illuminated. The displays are then cleared from the display face and a further player uses the machine to obtain a hand which is compared with the first mentioned hand to obtain a winner. Each player has the option of rejecting a predetermined number of cards as they are illuminated.

A more sophisticated form of the above described machine is known at least in Australia and has two separate indentical visual display faces enabling two games to be played simultaneously. In other words when a game is initiated, usually by insertion of a coin, a card is illuminated alternately on one display face and then the other. A reject facility is provided for each display face. This machine avoids a disadvantage of the earlier machine in that it is not necessary to remember the hand obtained by the first player during the time the second player obtains his hand because both hands are displayed simultaneously at the end of the game. However, this latter type of machine suffers the disadvantage of high cost brought about by the fact that it effectively comprises duplication of the earlier machine in that each playing face requires an addressable memory element for display, a cancel record circuit, a cancel number display, cancel count circuit, and means to count set displays to end a play.

The object of the present invention is to provide a machine which is capable of simultaneously provided, on separate display faces, the results of at least two consecutive hands or plays without requiring the duplication of electronic circuitry inherent in the prior art.

In order that the invention may be more readily understood, one particular embodiment will now be described with reference to the accompanying drawings wherein:

FIGS. 2 through 15 are more detailed illustrations of the circuitry contained in the block diagram of FIG. 1 and FIG. 16 is diagramatic representation of the front panel or display face according to the embodiment.

Figure 1:
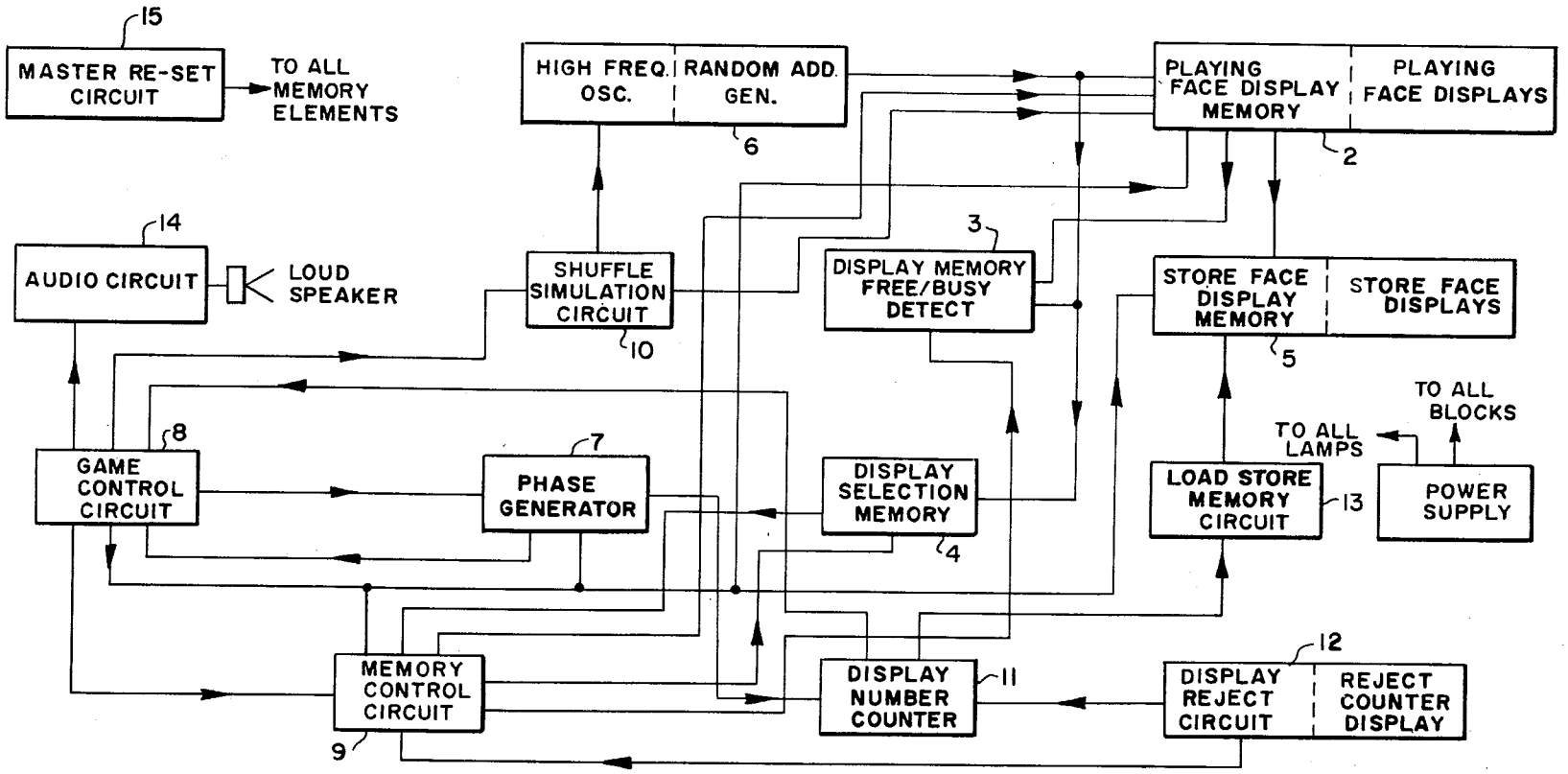
FIG. 1 is a circuit block diagram of the complete machine according to the embodiment wherein each block is labelled and consequently this figure does not require further explanation.

A description of the above circuits is given in the following discussion of the machine operation. To assist the understanding of the circuit diagrams, the following table indicates the various types of devices illustrated therein.

| Drawing Symbol Number | Device Type |
|---|---|
| 20 | 1 of 10 decoder |
| 21 | 8 bit addressable latch |
| 23 | 16 input multiplexer |
| 25 | inverter |
| 26 | logic OR gate |
| 33 | dual 4 bit latch |
| 39 | logic NAND gate |
| 40 | Binary counter |
| 41 | JK flip flop |
| 87 | D flip flop |
| 139 | High power driving circuit |
| 151 | Audio amplifier circuit |
| 153 | Zenner diode |
| 154 | Transistor |
| 58 | Resistor |

MACHINE OPERATION

Consider that the machine illustrated in FIG. 16 has just had mains power connected to it. A Master Re-set pulse is generated by the circuit shown in FIG. 15. This is to ensure that all memory elements in the apparatus are set to their pre-game state. Hence the $\overline{Q}$ of 156 is low causing five predetermined displays on the playing face to be illuminated via 157 to enhance the player appeal of the machine. Also, prior to any game commencement, the machine name is illuminated for approximately two seconds in approximately every four second period. This also serves as a means of player appeal.

A game commences by the insertion of a coin or token in the coin slot which causes the following actions to occur:

i. A coin counter 52 (FIG. 8) is stepped one position.
ii. Set displays on either or both display faces are re-set.
iii. The machine name lamps are held illuminated.
iv. Flip Flop 61 in the game control circuit (FIG. 8) is set which causes the start lamp to be illuminated.

In this condition the game may be started by one of two actions:

1. A player presses the start button 53
2. A timer 68 times out after a pre-determined time.

Either of these actions, via 54, 56, 64, 63, causes the Q output of flip flop 61 to go to a logic low level (0 Volts). This turns off transistor 59 and extinguishes the start lamp 60. Furthermore, the $\overline{Q}$ output of 61 goes to a logic high level ($\approx$4 Volts) which sets the $\overline{Q}$ of 62 to a logic low level. This enables the phase generator circuit elements 42*a* and 43*a* (FIG. 7). Also the high logic level at the $\overline{Q}$ output of 61 holds a re-set state to the auto start timer 68. The next action is that a clock pulse $\phi$1 occurs at the output of 42 (FIG. 7). $\phi$1 sets flip flop 76 (FIG. 8) such that the output of 77 goes high. This in turn enables gate 117 (FIG. 10) which allows pulses from the shuffle simulation circuit to appear on the enable wire of the playing face display memory via 81, 82, 83, 84 (FIG. 9). At the same time a 20Hz clock on Y from the shuffle simulation circuit is gated to the data wire via 94 (FIG. 9). Displays are momentarily illuminated thus giving a shuffle effect. Furthermore, the low logic state from the output of 78 (FIG. 8) causes the inhibit to be lifted off the audio circuit which causes an audio tone to occur. This state continued for approximately 3 seconds after which clock pulse $\phi$2 occurs at the output of 43 (FIG. 7).

This resets flip flop 76 (FIG. 8) which causes the shuffle effect and the audio tone to cease. In addition $\phi 2$, via inverter 86 (FIG. 9) clocks flip flop 87. The $\overline{Q}$ output of flip flop 87 enables the binary counter 90 and also sets a high logic level on the data wire C in FIG. 2 via gate 93. The Q output of flip flop 87 removes a re-set state from flip flop 103.

A search for a free memory location now commences at the rate of 2.5 kilohertz. Gates 97, 98, 99 are so connected to counter 90 that three sequential clock phases are developed. Phase $\phi a$ occurs first followed by $\phi b$ followed by $\phi c$. When $\phi a$ occurs flip flop 95, 96 is set such that the output K goes low (OV). Output K disables one input of gate 39 in FIG. 6 which halts the random address generator.

The output from the display selection memory (FIG. 4) wire Z will be low if the display memory address is not free for selection, that is it has previously been selected in the current game. Therefore when $\phi b$ occurs the output of gate 102 will not change and gate 109 output remains high. When $\phi c$ occurs flip flop 95, 96 is re-set via gate 105. This lifts the inhibit off gate 39 FIG. 6 and allows the random address generator to step on. When during subsequent sampling Z is high the occurrence of $\phi b$ sets flip flop 103 via gate 102. clock pulse $\phi c$ occurs the output of gate 106 goes to a logic low and 105 output does not change. This causes the following actions to occur. Firstly, an enable pulse is applied to the enable wire in FIG. 2 via gate 83 and inverter 84. This causes a bit to be set in the playing face display memory, which in turn causes a display to be illuminated. Secondly, flip flop 118 (FIG. 11) is set such that gate 119 output is a logic high.

Another occurrence is that the display selection memory bit associated with the set playing face memory bit is also set direct from the output of 106 (FIG. 9). It should be noted that the display selection memory is set whenever a playing face display memory bit is set. In effect, this means that a playing face memory bit, once set, is not available for re-selection throughout the game, even though it may be re-set by a player. The next $\phi a$ to occur causes the output of gate 108 to go low which re-sets flip-flop 87 via 89 and 88 causing counter 90 to be held re-set, thus completing the display selection sequence.

$\phi c$ also sets flip flop 128 in the display reject circuit (FIG. 12) is set which causes the output of gate 130 to be a high logic level. At this stage the reject counter 136 is at count 0 and gate 137 output is a high logic level. Gate 135 output is also high and so gate 127 output goes low illuminating reject lamp 125 via driver 126.

The display reject circuit is now active. If a player chooses not to reject a set display, the reject circuit remains active for approximately 3 seconds. If, however, the reject button 131 is activated, the output from gate 133 pulses low. This causes three separate actions. Firstly, the enable wire of the playing face display memory (FIG. 2) is pulsed, and recall that flip flop 87 (FIG. 9) was re-set earlier hence the state on the data wire of the playing face memory circuit is a logic low. Therefore, the playing face display memory bit is re-set which extinguishes the display. Secondly, flip flop 118 in the display number counter (FIG. 11) is set such that gate 119 output goes to a low state. Thirdly, flip flop 134, 135 (FIG. 12) is set causing the output of gate 135 to go low which clocks the reject counter 136 to give the binary address 001. This address is decoded by 138 and lamp 140 is illuminated via a driving circuit 139. Furthermore, the low state at the output of gate 135 causes the output of gate 127 to go high. This in turn causes the reject lamp 125 to be extinguished. Next, clock pulse $\phi 3$ occurs at the output of 44 (FIG. 7). This pulse re-sets flip flop 128 (FIG. 12) thus disabling the reject circuit.

Clock pulse $\phi 4$ occurs next at the output of gate 45 (FIG. 7). It is used to sample the output of flip flop 118 (FIG. 11). Recall that this flip flop is set when a display is selected and re-set if a display is rejected. Hence, the display number counter 122 is only clocked if a display is not rejected.

The other function of $\phi 4$ is to re-set flip flop 95, 96 (FIG. 9) which allows the random address generator to run on.

Clock pulse $\phi 5$ occurs next at the output of 46 (FIG. 7), it is inverted by 47 and passes onto the display number counter circuit (FIG. 11). Its function is to sample the counter output. This action will be discussed shortly. Clock pulse $\phi 1$ now occurs again and the above described sequence is repeated again.

When five rejects have been made, lamp 5 (FIG. 12) is illuminated and the output of gate 137 is low. This inhibits the reject button signal and stops the reject lamp from being illuminated. When 5 displays of the playing face are illuminated, counter 122 (FIG. 11) outputs high states to gate 123. The next time clock pulse $\phi 5$ occurs the output of gate 123 goes low.

The output of gate 123 connects to inverter 141 (FIG. 13) and the high going pulse at its output via 142 causes flip flop 143, 145 to be set such that the output of gate 143 goes high. This in turn switches on transistor 146 thus illuminating the "first hand" lamp 147. The first hand display can be seen in FIG. 16 which shows a face view of the machine.

When the output of gate 143 goes high, it causes the output of gate 145 to go low. This in turn causes the output of gate 142 to go high. Hence, a short negative going pulse occurs at the output of gate 142. This pulse clocks the store face display memory (FIG. 5) and since the output of the playing face display memory is connected to the input of the store face display memory, the contents of the playing face display memory are written into the store face display memory. Approximately 100 nanoseconds later the playing face display memory is cleared via inverter 148 (FIG. 13), 67 (FIG. 8), 91 and 92 (FIG. 9).

The visual effect of this action is that the illuminated displays appear to shift from the playing face to the store face. Further, the short negative going pulse at the output of 67 (FIG. 8) re-sets flip flop 62 via 66 and 65. This re-sets and halts the phase generator circuit FIG. 7.

Two further actions occur as a result of the negative going pulse at inverter 67 output. One is that the display reject counter is re-set via gate 55, extinguishing any illuminated reject number lamp. Secondly, flip flop 61 is clocked and the Q output goes high. The game control circuit is now in the same condition as it was when the game commenced by the activation of the micro switch 49. Hence, the play cycle now repeats itself.

The display number counter (FIG. 11) counts on from 5 and when count 10 is reached, i.e. the second play is completed, it outputs high states to gate 124. Hence, when the next clock $\phi 5$ occurs, the output of gate 124 goes low. This causes flip flop 62 (FIG. 8) to be re-set via gate 66 and inverter 65. The Q output goes high which re-sets and halts the clock phase generator in FIG. 7. Further, flip flop 67 (FIG. 8) is re-set such that gate 70 output goes high. The output of divider 75 and 74 is changing from a high logic state to a low logic state approximately every 2 seconds. Therefore, the output of gate 71 now changes from high to low every 2 seconds. This causes the game name lamp to flash on and off at the same rate.

The machine has now completed a game and both the hands from the two plays are left displayed.

When another game is initiated the displays on both the playing face and the store face are extinguished together with the reject number display.

FIG. 15 illustrates the master re-set circuit and the circuit for illuminating five set displays on power-up.

The master re-set circuit extends a re-setting logic state to all memory devices via 155 whenever the +5 volt power to the logic circuit is below a reliable operating level. The audio circuit (FIG. 14) consists of a sine wave oscillator 150 whose frequency is changed from one to another under the control of an astable multi vibrator 149. This audio signal is amplified by 151 and fed to a speaker 152.

THE STORE FUNCTION

The store face or faces is the major feature of this invention and therefore a more detailed description of this function will now be given.

The store face display memory illustrated in FIG. 5 consists of four dual 4 bit latch devices 33. However, other memory elements could be used. The inputs to the devices are directly wired to the outputs of the playing display memory devices 21 (FIG. 2). The wiring relationship is such that output one goes to input one, output 2 goes to input 2 and so on through to 32. After the first play is completed, the first hand indicator is illuminated and at the same time the store face displays are illuminated. At this point in time the contents of the store face display memory is identical to the contents of the playing face display memory. However, the playing face display memory is cleared very quickly after the store face display memory is loaded which gives the visual effect of the displays transferring from the playing face to the store face.

GENERAL

Random address generation is achieved by ANDing a very fast oscillator and a very slow oscillator and using the output to clock a binary address generator. This can be clearly seen in FIG. 6.

The machine play time can be altered within certain practical limits without causing timing hazards within the machine. This is due to all functions in the machine being controlled in a strict phase relationship.

The particular embodiment illustrated in FIG. 16 shows that the playing face displays and the store face displays are identical. They contain 32 cards from ace through to 7 in each of the four suits. The remaining functions indicated on the face are self explanatory and have been described above under machine operation.

It should be apparent to those skilled in the art that the present invention, as illustrated in the above embodiment, provides a machine which substantially reduces the amount of electronic circuitry necessary to provide displays for two consecutive plays on an amusement machine. Of course, the invention is not limited to the particular embodiment described above as improvements and modifications may be readily effected by persons skilled in the art. For example, the machine could have several storage faces enabling say three or four players to obtain hands on the playing face in turn and transfer the hands to respective storage faces. Also, whilst in the above embodiment, the cards illuminated on the storage face or those which have been rejected are prevented from appearing on the playing face, a modification can be readily effected whereby cards illuminated on the storage face or faces and those rejected can also become illuminated on the playing face within the same game. This modification would have the disadvantage that it would be possible for different players to obtain the same hand.

What is claimed is:

1. An electronic amusement machine including a visual display having at least two sets of individual characters, the characters of each set corresponding to the characters of the other of said at least two sets, one of said sets being a playing set and the other of said at least two sets being a storage set, said machine including first circuit means to randomly illuminate a predetermined number of characters of said playing set during successive plays of a game and second circuit means to transfer the result of completed plays on said playing set to said storage set, and means for storing said results at least until the last play is completed on said playing set.

2. A machine as defined in claim 1 wherein the individual characters of each set represent playing cards for playing poker.

3. A machine as defined in claim 2 further comprising means for individually illuminating said cards on said playing set in a time spaced relationship and third circuit means for providing a reject facility whereby cards may be rejected as they are illuminated, the number of rejects being a maximum of five and the total number of illuminated cards on said playing set on completed plays being five.

4. A machine as defined in claim 1 wherein said first circuit means include a random address generator and an addressable latch circuit and said second circuit means includes a counter to determine when a play is completed on said playing set and to provide a clock pulse to a latch circuit to transfer the result of respective plays to said storage set or sets, respectively, the last play remaining on said playing set.

5. An electronic amusement machine including a visual display comprising a playing face having many differing individual characters capable of illumination during a game and a storage face having individual characters representing the characters of said playing face said storage face being capable of illumination during a game, said machine including first circuit means adapted, in use, to successively illuminate, during a first play, a predetermined number of characters of said playing face in a random manner and second circuit means to transfer the results of said first play to said storage face by illuminating the characters of said storage face representing the illuminated characters of the playing face, said first circuit means enabling a second play to be made whereby a similar number of cards to said first play are illuminated on said playing face, to enable the results of said second play to be compared with the results of said first play in accordance with a predetermined set of rules.

6. A machine as defined in claim 5 wherein the individual characters of each face represent playing cards for playing poker.

7. A machine as defined in claim 6 further comprising means for individually illuminating said cards on said playing face in a time spaced relationship and third circuit means for providing a reject facility whereby cards may be rejected as they are illuminated, the number of rejects being a maximum of five and tht total number of illuminated cards on said playing face on completed plays being five.

8. A machine as defined in claim 5 wherein said first circuit means includes a random address generator and an addressable latch circuit and second circuit means includes a counter to determine when a play of a game is completed on said playing face and provide a clock pulse to a latch circuit to transfer the result to said storage face.

* * * * *